US012006108B2

(12) United States Patent
Minnette et al.

(10) Patent No.: US 12,006,108 B2
(45) Date of Patent: Jun. 11, 2024

(54) TETHERED CAP AND SPOUT

(71) Applicant: Nypro Inc., Clinton, MA (US)

(72) Inventors: Jeffrey C. Minnette, Clinton, MA (US); Ryan P. Davidson, Clinton, MA (US)

(73) Assignee: Nypro Inc., Clinton, MA (US)

( * ) Notice: Subject to any disclaimer, the term of this patent is extended or adjusted under 35 U.S.C. 154(b) by 0 days.

(21) Appl. No.: 17/601,229

(22) PCT Filed: Apr. 3, 2020

(86) PCT No.: PCT/US2020/026529
§ 371 (c)(1),
(2) Date: Oct. 4, 2021

(87) PCT Pub. No.: WO2020/206215
PCT Pub. Date: Oct. 8, 2020

(65) Prior Publication Data

US 2022/0177188 A1 Jun. 9, 2022

Related U.S. Application Data

(60) Provisional application No. 62/829,762, filed on Apr. 5, 2019.

(51) Int. Cl.
*B65D 5/74* (2006.01)
*B65D 55/16* (2006.01)

(52) U.S. Cl.
CPC ..... *B65D 5/748* (2013.01); *B65D 55/16* (2013.01); *B65D 2401/15* (2020.05)

(58) Field of Classification Search
CPC .... B65D 5/748; B65D 55/16; B65D 2401/15; B65D 2251/1008
USPC ..... 220/200
See application file for complete search history.

(56) References Cited

U.S. PATENT DOCUMENTS 3,209,963 A * 10/1965 Krieps ..... B65D 47/0842 222/543
3,272,368 A * 9/1966 Van Baarn ..... B65D 41/485 215/320
4,700,858 A * 10/1987 Bennett ..... B65D 47/0819 220/838

(Continued)

FOREIGN PATENT DOCUMENTS

BR MU9100630 U2 * 5/2013 ..... B65D 5/748
CN 101056799 A 10/2007

(Continued)

*Primary Examiner* — Don M Anderson
*Assistant Examiner* — Eric C Baldrighi
(74) *Attorney, Agent, or Firm* — Young Basile Hanlon & MacFarlane, P.C.

(57) ABSTRACT

Disclosed herein are tethered cap and spout combinations. The tethered cap and spout combinations prevent loss of the cap after opening. The tethered cap and spout combinations may provide mechanisms for puncturing or opening a seal that may be present at a throat or neck of the container which provides both an anti-tampering and freshness function. In an implementation, the tethered cap and spout combinations may provide anti-tampering mechanisms. The tethered cap and spout combinations may provide mechanisms to hold an opened and tethered cap away from the container opening during use.

14 Claims, 19 Drawing Sheets

(56) References Cited

U.S. PATENT DOCUMENTS

| | | | | |
|---|---|---|---|---|
| 4,795,044 | A * | 1/1989 | Beck | B65D 47/0814 215/253 |
| 5,725,115 | A | 3/1998 | Bosl et al. | |
| 7,997,436 | B2 * | 8/2011 | Bolli | B65D 5/748 215/297 |
| 8,672,167 | B2 * | 3/2014 | Leuenberger | B65D 5/748 220/267 |
| 2008/0073348 | A1 | 3/2008 | Pritikin et al. | |
| 2008/0105640 | A1 | 5/2008 | Ott | |
| 2008/0210745 | A1 * | 9/2008 | Rigling | B65D 5/748 229/125.24 |
| 2009/0145873 | A1 | 6/2009 | Park | |
| 2012/0024815 | A1 * | 2/2012 | Kwon | B65D 41/3409 215/272 |
| 2012/0181281 | A1 * | 7/2012 | Ott | B65D 5/748 220/277 |
| 2012/0285921 | A1 * | 11/2012 | Kwon | B65D 55/16 215/243 |
| 2013/0043260 | A1 | 2/2013 | Barron | |
| 2013/0256336 | A1 * | 10/2013 | Himmelsbach | B65D 47/14 222/81 |
| 2019/0071224 | A1 * | 3/2019 | Berge | B65D 5/748 |
| 2020/0017260 | A1 * | 1/2020 | Migas | B65D 51/248 |
| 2021/0323739 | A1 * | 10/2021 | Lamoureux | B65D 55/16 |
| 2022/0371772 | A1 * | 11/2022 | Wassum | B65D 41/3409 |

FOREIGN PATENT DOCUMENTS

| | | | | |
|---|---|---|---|---|
| CN | 101316764 | A | 12/2008 | |
| CN | 101720298 | A | 6/2010 | |
| CN | 101861275 | A | 10/2010 | |
| CN | 102883963 | A | 1/2013 | |
| DE | 102019132541 | B3 * | 11/2020 | B65D 5/748 |
| EP | 3715274 | A1 * | 9/2020 | B65D 55/16 |
| KR | 100855087 | B1 | 8/2008 | |
| WO | WO-9701491 | A1 * | 1/1997 | B65B 61/186 |
| WO | 9951502 | A1 | 10/1999 | |
| WO | 0105675 | A1 | 1/2001 | |
| WO | WO-2020193089 | A1 * | 10/2020 | B65D 43/169 |
| WO | WO-2022073661 | A1 * | 4/2022 | B65D 41/34 |
| WO | WO-2022232907 | A1 * | 11/2022 | B65D 41/34 |

* cited by examiner

TETHERED CAP AND SPOUT

CROSS-REFERENCE TO RELATED APPLICATION(S)

This application is a national stage 371 application of PCT/US2020/026529, filed Apr. 3, 2020, which claims priority to U.S. Provisional Application No. 62/829,762, filed Apr. 5, 2019, the entire disclosures of which are hereby incorporated by reference.

TECHNICAL FIELD

This disclosure relates to packaging and in particular, tethered caps and spouts for containers.

BACKGROUND

Containers, such as bottles, use caps to seal and contain a material in the container. Removal of the cap allows access to the material. However, the cap may be mislaid or lost, and re-closing of the container is then not possible.

SUMMARY

Disclosed herein are tethered cap and spout combinations. The tethered cap and spout combinations prevent loss of the cap after opening. In an implementation, the tethered cap and spout combinations may provide mechanisms for puncturing or opening a seal that may be present at a throat or neck of the container which provides both an anti-tampering and freshness function. In an implementation, the tethered cap and spout combinations may provide anti-tampering mechanisms. In an implementation, the tethered cap and spout combinations may provide mechanisms to hold an opened and tethered cap away from the container opening during use.

BRIEF DESCRIPTION OF THE DRAWINGS

The disclosure is best understood from the following detailed description when read in conjunction with the accompanying drawings and are incorporated into and thus constitute a part of this specification. It is emphasized that, according to common practice, the various features of the drawings are not to-scale. On the contrary, the dimensions of the various features are arbitrarily expanded or reduced for clarity.

DETAILED DESCRIPTION

Figure 1:
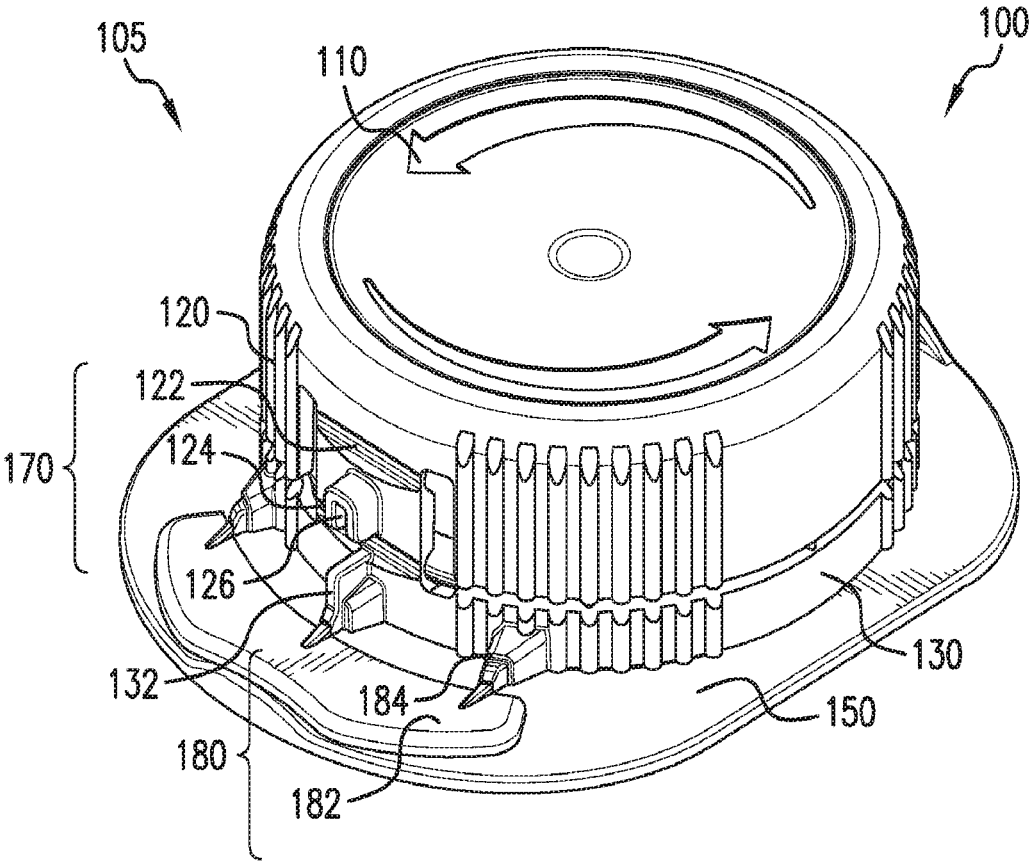
FIG. 1 is a diagram of a tethered cap and spout combination in a closed position in accordance with implementations.

The figures and descriptions provided herein may be simplified to illustrate aspects of the described embodiments that are relevant for a clear understanding of the herein disclosed processes, machines, manufactures, and/or compositions of matter, while eliminating for the purpose of clarity other aspects that may be found in typical similar devices, systems, compositions and methods. Those of ordinary skill may thus recognize that other elements and/or steps may be desirable or necessary to implement the devices, systems, compositions and methods described herein. However, because such elements and steps are well known in the art, and because they do not facilitate a better understanding of the disclosed embodiments, a discussion of such elements and steps may not be provided herein. However, the present disclosure is deemed to inherently include all such elements, variations, and modifications to the described aspects that would be known to those of ordinary skill in the pertinent art in light of the discussion herein.

Embodiments are provided throughout so that this disclosure is sufficiently thorough and fully conveys the scope of the disclosed embodiments to those who are skilled in the art. Numerous specific details are set forth, such as examples of specific aspects, devices, and methods, to provide a thorough understanding of embodiments of the present disclosure. Nevertheless, it will be apparent to those skilled in the art that certain specific disclosed details need not be employed, and that embodiments may be embodied in different forms. As such, the exemplary embodiments set forth should not be construed to limit the scope of the disclosure.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof.

The steps, processes, and operations described herein are thus not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

Yet further, although the terms first, second, third, etc. may be used herein to describe various elements, steps or aspects, these elements, steps or aspects should not be limited by these terms. These terms may be only used to distinguish one element or aspect from another. Thus, terms such as "first," "second," and other numerical terms when used herein do not imply a sequence or order unless clearly indicated by the context. Thus, a first element, step, component, region, layer or section discussed below could be termed a second element, step, component, region, layer or section without departing from the teachings of the disclosure.

The non-limiting embodiments described herein are with respect to tethered cap and spout combinations. The tethered cap and spout combinations and methods for making the tethered cap and spout combinations may be modified for a variety of applications and uses while remaining within the spirit and scope of the claims. The embodiments and variations described herein, and/or shown in the drawings, are presented by way of example only and are not limiting as to the scope and spirit. The descriptions herein may be applicable to all embodiments of the device and the methods for making the devices.

Disclosed herein are implementations of tethered cap and spout combinations. The implementations shown are illustrative and other implementations may include grips or protrusions for aiding in opening the cap which are within the scope of the specification and claims described herein.

FIG. 1 is a diagram of a tethered cap and spout combination 100 in a closed position in accordance with implementations. The tethered cap and spout combination 100 includes a cap 105, a retaining element 130, a retaining element lock mechanism 140 (shown in FIG. 5), and a spout 150. The cap 105 includes a base 110 and a sidewall 120. For example, the retaining element 130 may be a retaining ring. The sidewall 120 includes a first hinge mechanism 122 connected to the sidewall 120 and a second hinge mechanism 124 connected to the retaining element 130. A cap engagement slot 126 is connected between the first hinge mechanism 122 and the second hinge mechanism 124. The cap engagement slot 126 is associated with a cap member 132 disposed on the retaining element 130. The first hinge mechanism 122, the second hinge mechanism 124, and the cap engagement slot 126 comprise a tether 170. A position-retaining element rupture mechanism 180 is disposed on or between the spout 150 and the retaining element 130 and maintains the position of the retaining element 130 prior to use of the tethered cap and spout combination 100. The position-retaining element rupture mechanism 180 includes a spout portion 182 and a retaining element portion 184. The spout portion 182 and the retaining element portion 184 are tearably connected. In an implementation, the position-retaining element rupture mechanism 180 includes a plurality of retaining element portions 184 (e.g., three of the retaining element portions 184). In an implementation, the cap-retaining element rupture mechanism 180 may function as an anti-tampering device. In an implementation, the cap member 132 may be formed on the retaining element portion 184 of the position-retaining element rupture mechanism 180. In implementations where the position-retaining element rupture mechanism 180 includes a plurality of retaining element portions 184, the cap member 132 may be formed on one of the retaining element portions 184 of the plurality of retaining element portions 184.

Figure 2:
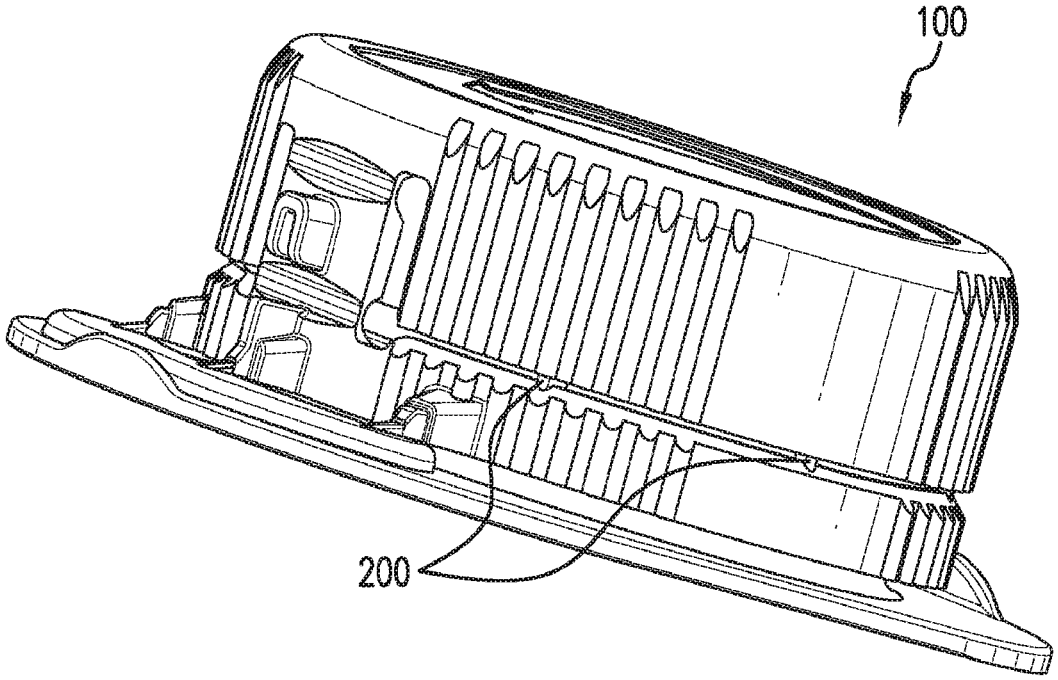
FIG. 2 is a side view of the tethered cap and spout combination of FIG. 1 in accordance with certain implementations.

FIG. 2 is a side view of the tethered cap and spout combination 100 of FIG. 1 in accordance with certain implementations. In addition to the elements shown in FIG. 1 and not repeated here for clarity, the tethered cap and spout combination 100 further includes a plurality of cap-retaining element elements 200 which attach the cap 105 to the retaining element 130. In an implementation, the plurality of cap-retaining element elements 200 may function as an anti-tampering device.

Figure 3:
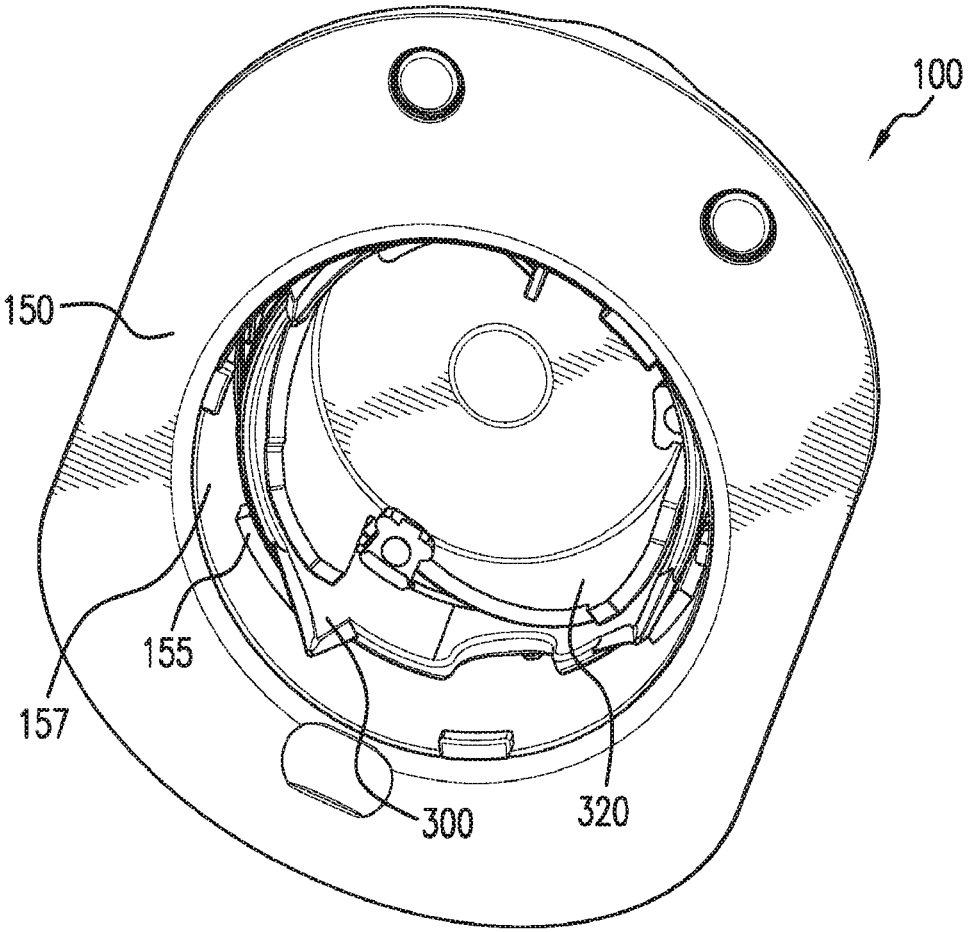
FIG. 3 is a bottom view of the tethered cap and spout combination of FIG. 1 in accordance with certain implementations.

FIG. 3 is a bottom view of the tethered cap and spout combination 100 of FIG. 1 in accordance with certain implementations. In addition to the elements shown in FIGS. 1 and 2 and not repeated here for clarity, the tethered cap and spout combination 100 further includes a puncturing mechanism 300 which is engaged with protrusions 155 on an internal wall 157 of the spout 150 and a camming mechanism 320 disposed internally with respect to the base 110 and the sidewall 120.

Figure 4:
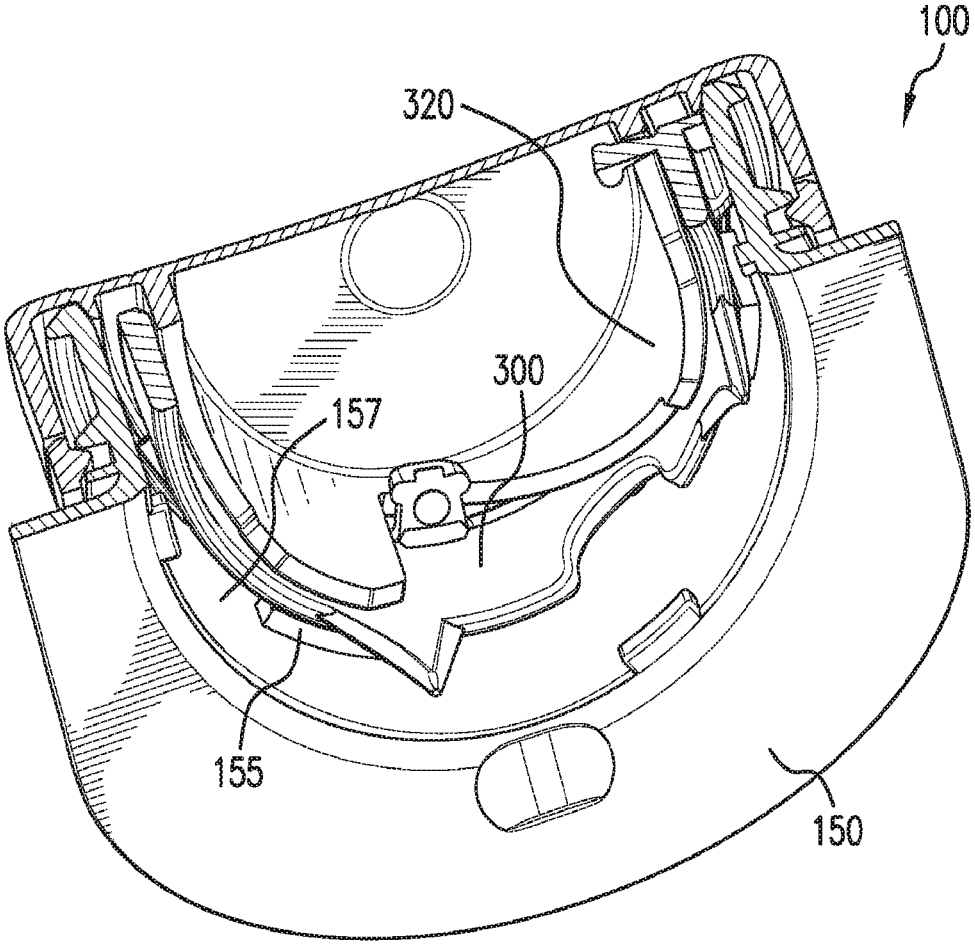
FIG. 4 is a bottom cross-sectional view of the tethered cap and spout combination of FIG. 1 in accordance with certain implementations.

FIG. 4 is a bottom cross-sectional view of the tethered cap and spout combination 100 of FIG. 1 in accordance with certain implementations and shows the elements described herein with respect to FIGS. 1-3.

Figure 5:
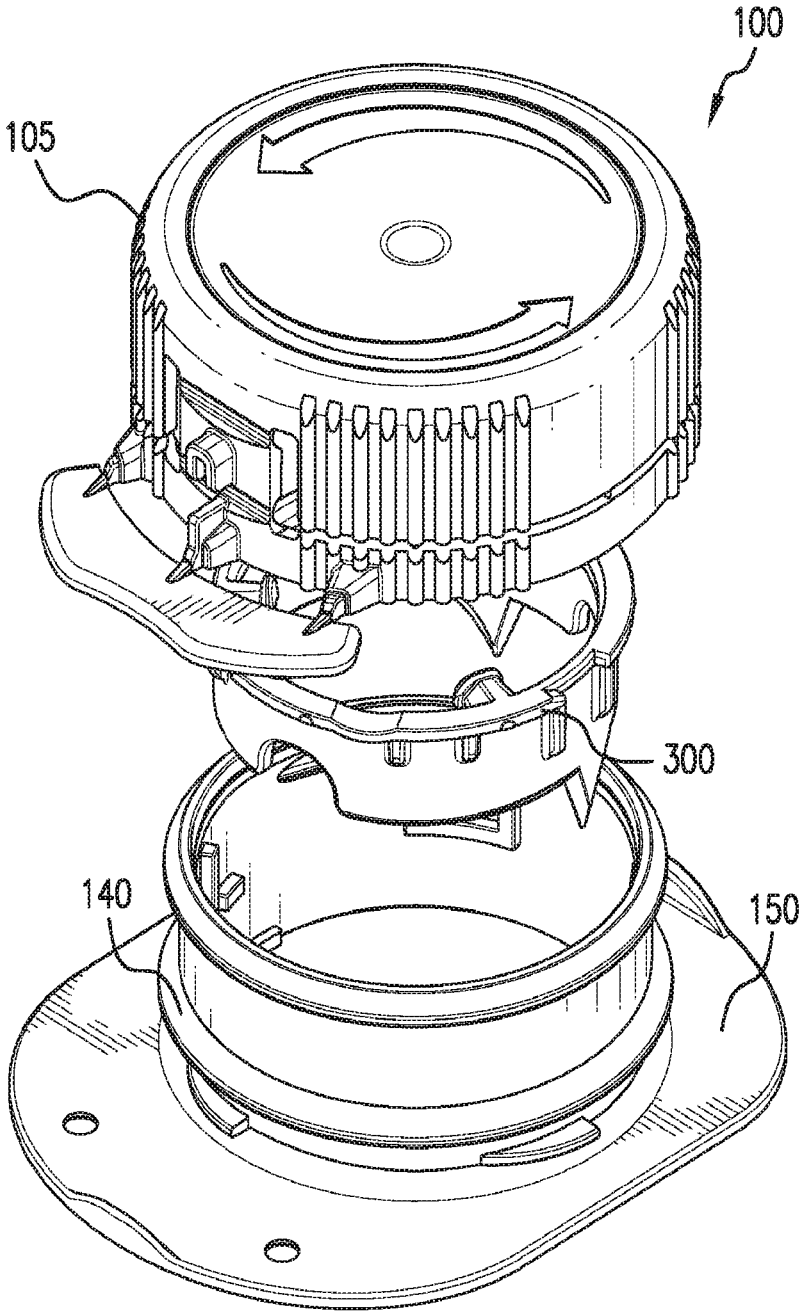
FIG. 5 is an exploded view of the tethered cap and spout combination of FIG. 1 in accordance with certain implementations.

FIG. 5 is an exploded view of the tethered cap and spout combination of FIG. 1 in accordance with certain implementations and shows the elements described herein with respect to FIGS. 1-3.

Figure 6:
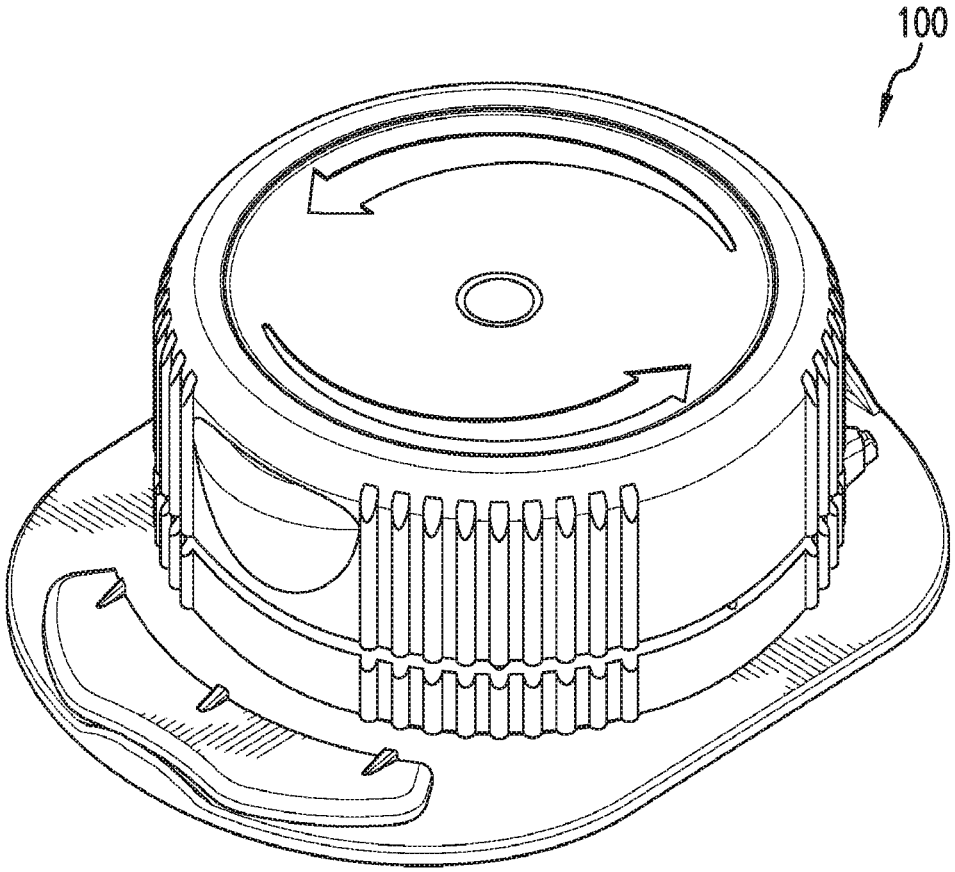
FIG. 6 is a view of the tethered cap and spout combination of FIG. 1 in a rotated position in accordance with implementations.

FIG. 6 is a view of the tethered cap and spout combination of FIG. 1 in a rotated position in accordance with implementations and shows the elements described herein with respect to FIGS. 1-3. In particular, the cap-retaining element rupture mechanism 180 is shown as ruptured.

Figure 7:
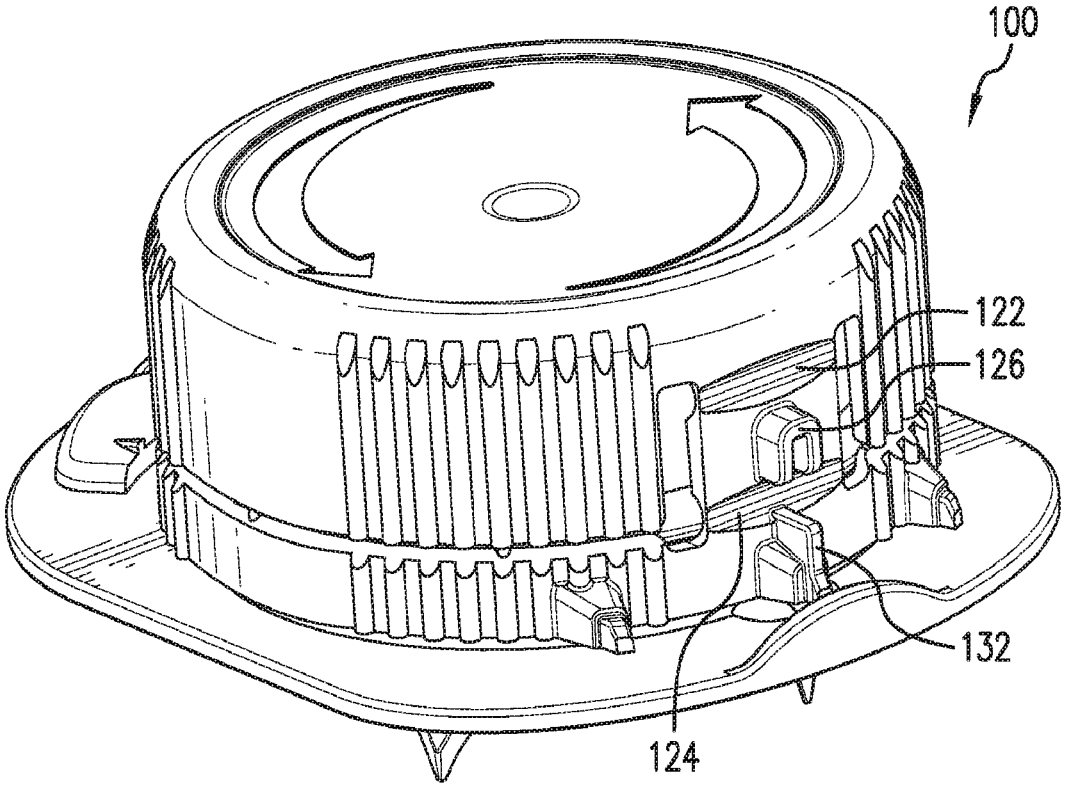
FIG. 7 is a rear view of the tethered cap and spout combination of FIG. 1 in a rotated position in accordance with certain implementations.

FIG. 7 is a rear view of the tethered cap and spout combination of FIG. 1 in a rotated position in accordance with certain implementations and shows the elements described herein with respect to FIGS. 1-3 and 6. In particular, the cap-retaining element rupture mechanism 180 is shown as ruptured.

Figure 8:
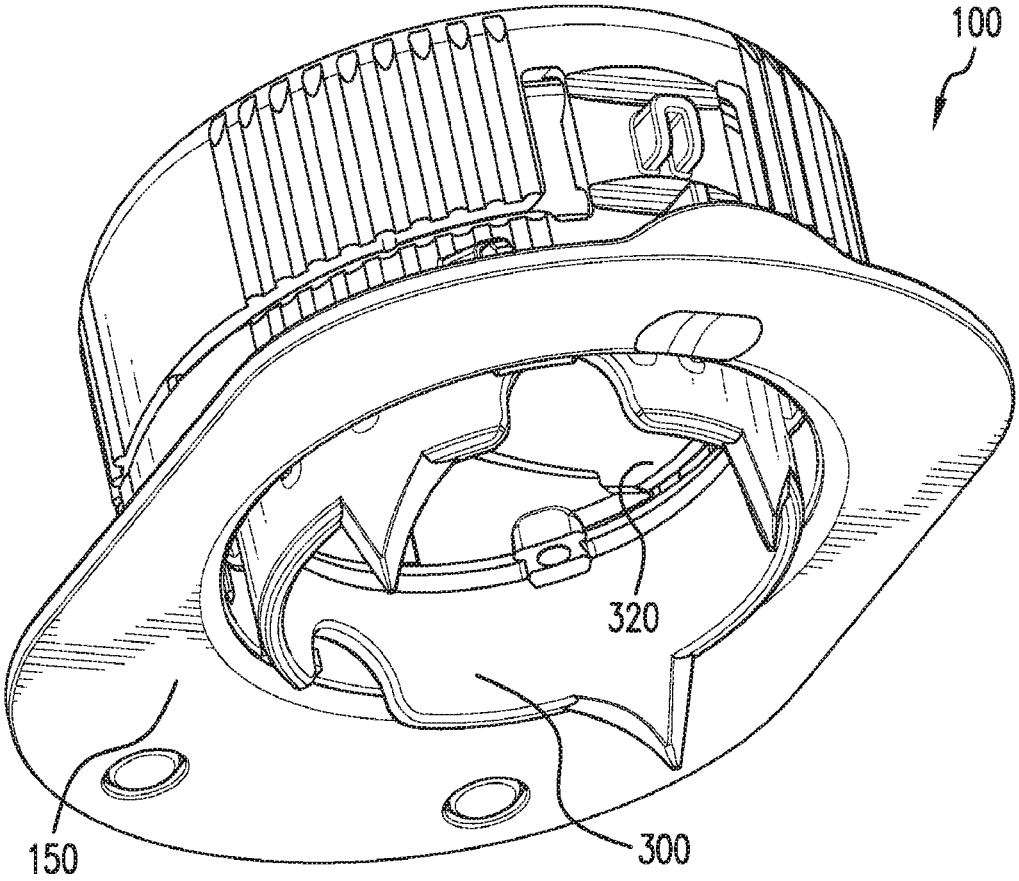
FIG. 8 is a bottom view of the tethered cap and spout combination of FIG. 1 in a rotated position in accordance with certain implementations.

FIG. 8 is a bottom view of the tethered cap and spout combination of FIG. 1 in a rotated position in accordance with certain implementations and shows the elements described herein with respect to FIGS. 1-3 and 6-7. In particular, the cap-retaining element rupture mechanism 180 is shown as ruptured. In particular, rotation of the cap 105 engages the camming mechanism 320 with the puncturing mechanism 300 and as shown, the puncturing mechanism 300 is now below the plane of the spout 150.

Figure 9:
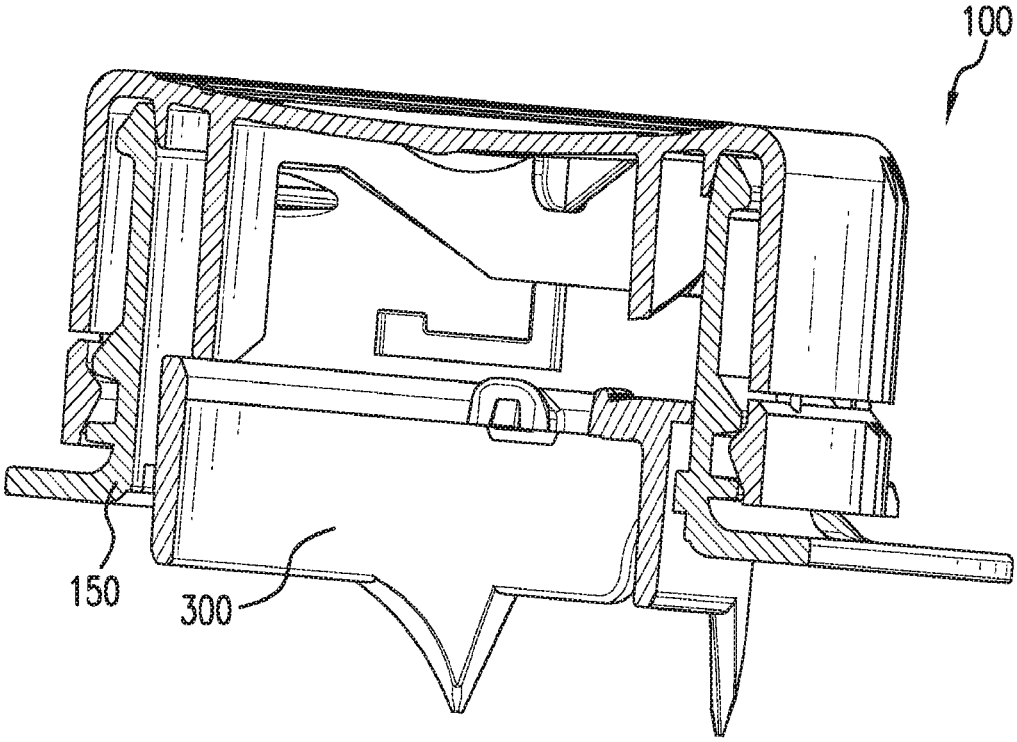
FIG. 9 is a cross-sectional view of the tethered cap and spout combination of FIG. 1 in a rotated position in accordance with certain implementations.

FIG. 9 is a cross-sectional view of the tethered cap and spout combination of FIG. 1 in a rotated position in accordance with certain implementations and shows the elements described herein with respect to FIGS. 1-3 and 6-8.

Figure 10:
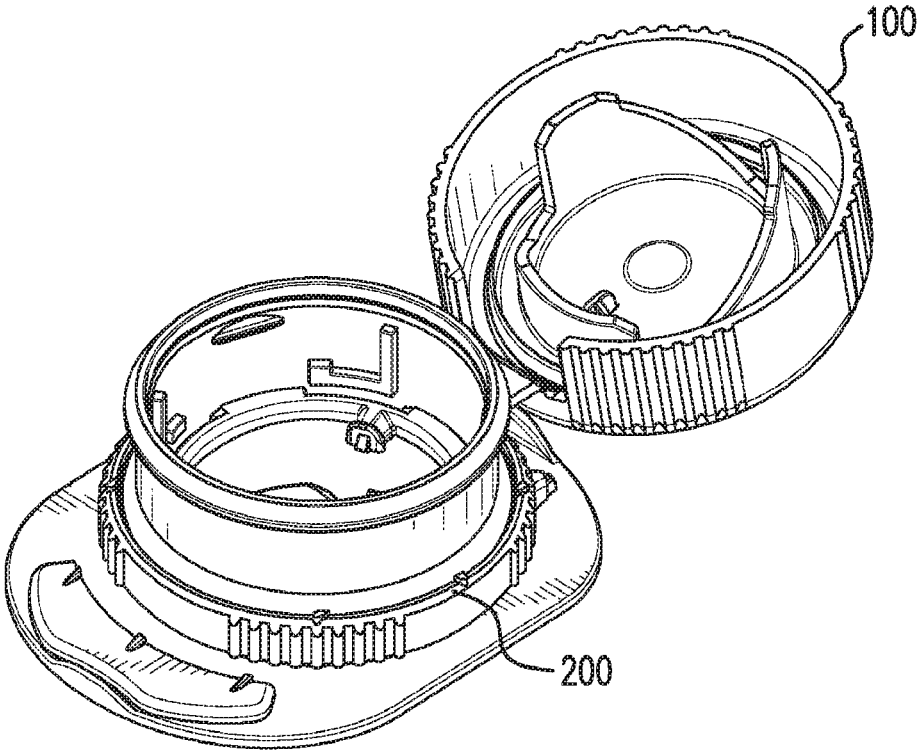
FIG. 10 is a view of the tethered cap and spout combination of FIG. 1 in an open position in accordance with certain implementations.

FIG. 10 is a view of the tethered cap and spout combination of FIG. 1 in an open position in accordance with certain implementations and shows the elements described herein with respect to FIGS. 1-3 and 6-9. In particular, the cap-retaining element elements 200 are now disengaged when the cap 105 is flipped open from the retaining element 130.

Figure 11:
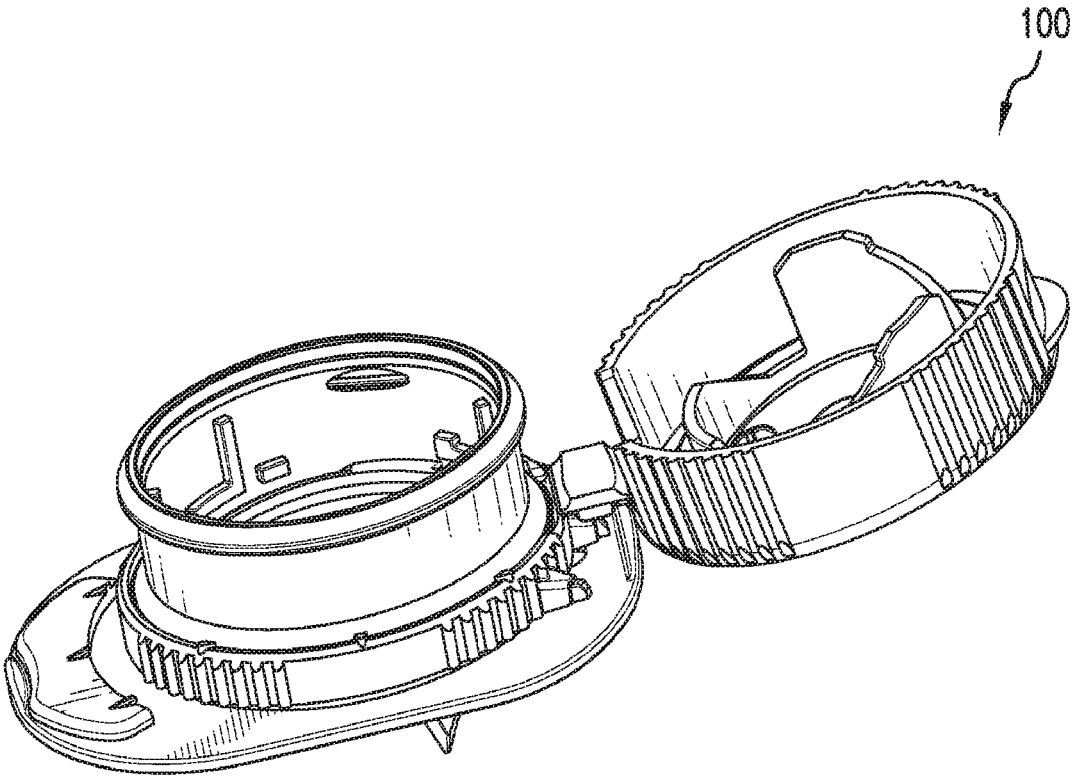
FIG. 11 is a side view of the tethered cap and spout combination of FIG. 1 in an open position in accordance with certain implementations.

FIG. 11 is a side view of the tethered cap and spout combination of FIG. 1 in an open position in accordance with certain implementations and shows the elements described herein with respect to FIGS. 1-3 and 6-10.

Figure 12:
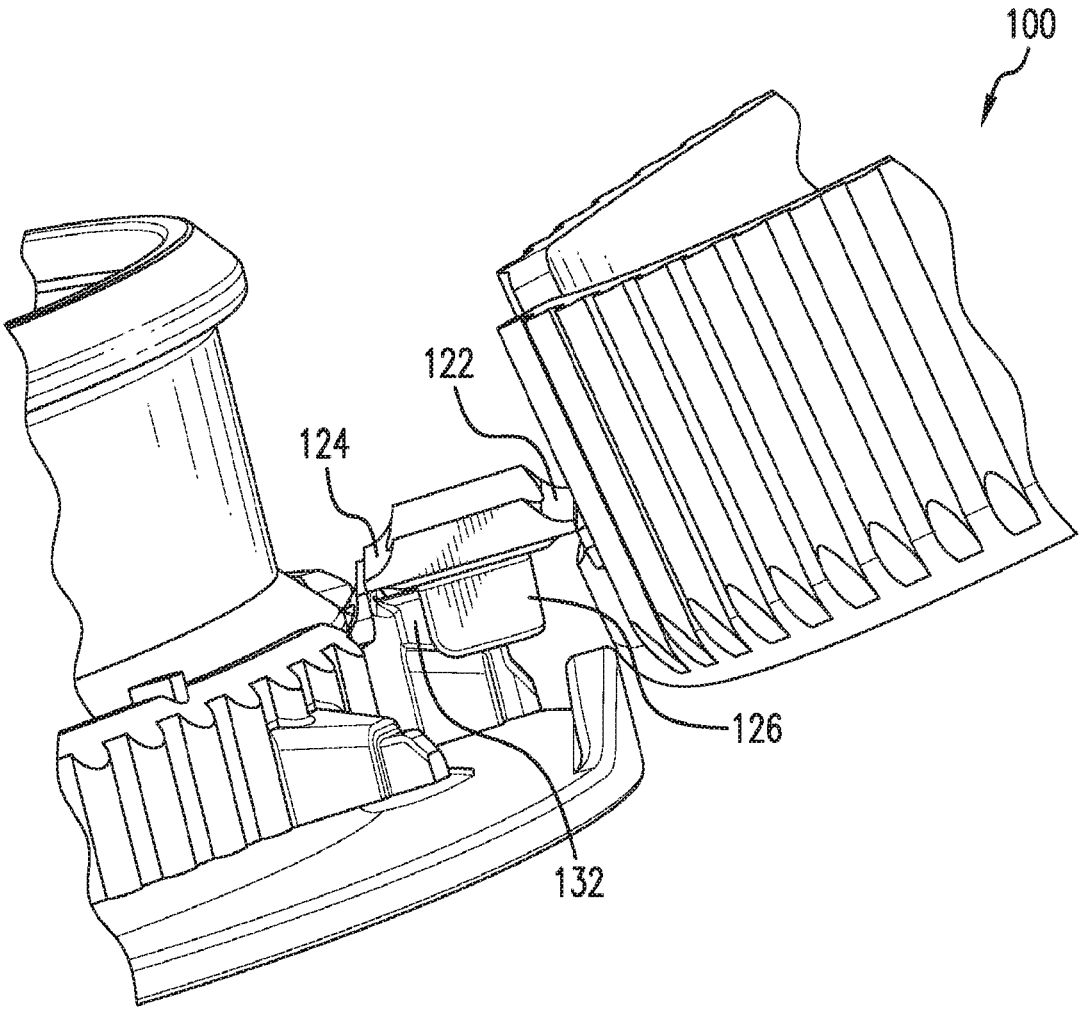
FIG. 12 is a zoomed view of the tethered cap and spout combination of FIG. 1 in an open position in accordance with certain implementations.

FIG. 12 is a zoomed view of the tethered cap and spout combination 100 of FIG. 1 in an open position in accordance with certain implementations and shows the elements described herein with respect to FIGS. 1-3 and 6-11. In particular, the cap engagement slot 126 is engaged with the cap member 132 when the cap 105 is flipped open. In addition, the first hinge mechanism 122 and the second hinge mechanism 124 are engaged when the cap 105 is flipped open and keep the cap 105 outside the space of the spout 150 opening.

Operationally, the cap 105 is rotated (for example 180°). This ruptures the cap-retaining element rupture mechanism 180. The camming mechanism 320 engages the puncturing mechanism 300, which may then puncture a seal on a container (where the tethered cap and spout combination 100 is implemented on the container). The cap 105 is flipped opener which ruptures the plurality of cap-retaining element elements 200. The cap 105 may then be held in place by engaging the cap engagement slot 126 with the cap member 132.

Figure 13:
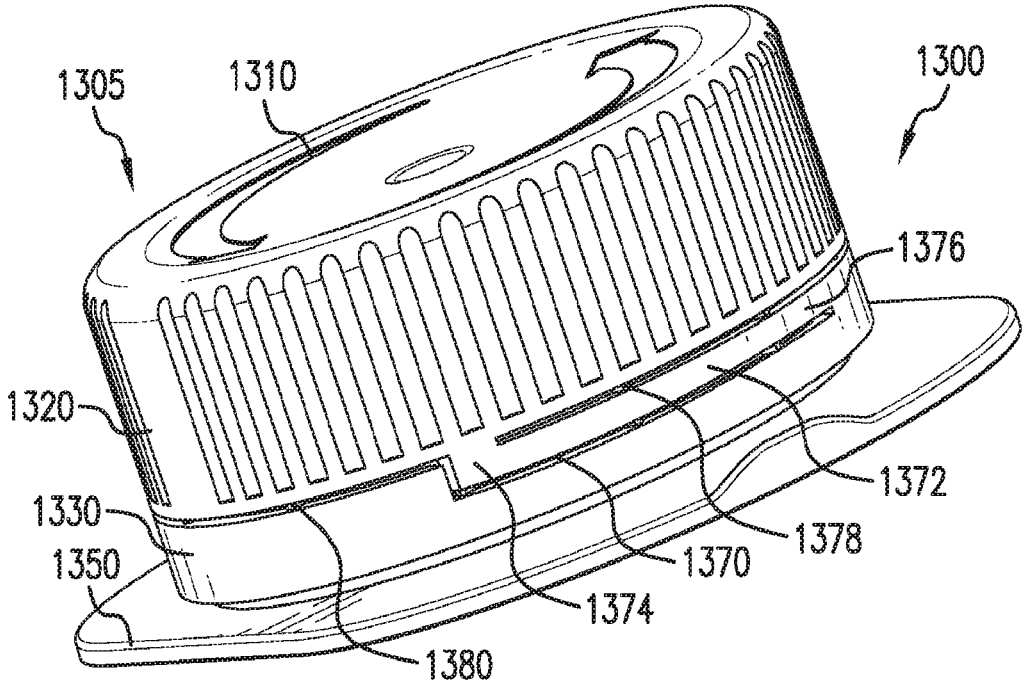
FIG. 13 is a view of another tethered cap and spout combination in a closed position in accordance with certain implementations.

FIG. 13 is a view of another tethered cap and spout combination 1300 in a closed position in accordance with certain implementations. The tethered cap and spout combination 1300 includes a cap 1305, a retaining element 1330, a retaining element lock mechanism 1340 (shown in FIG. 16), and a spout 1350. The cap 1305 includes a base 1310 and a sidewall 1320. The sidewall 1320 and the retaining element 1330 include a tether 1370. The tether 1370 includes a tether member 1372 which has a first end 1374 connected to the sidewall 1320 and a second end 1376 connected to the retaining element 1330. The tether 1370 is further connected to the sidewall 1320 and the retaining element 1330 via a plurality of rupture members 1378. The sidewall 1320 and the retaining element 1330 are attached via a plurality of rupture members 1380. In an implementation, plurality of rupture members 1378 and the plurality of rupture members 1380 may function as an anti-tampering device. The tether 1370 may be in part implemented as described in U.S. Pat. No. 5,725,115, which issued Mar. 10, 1998, and herein is incorporated by reference in its entirety.

Figure 14:
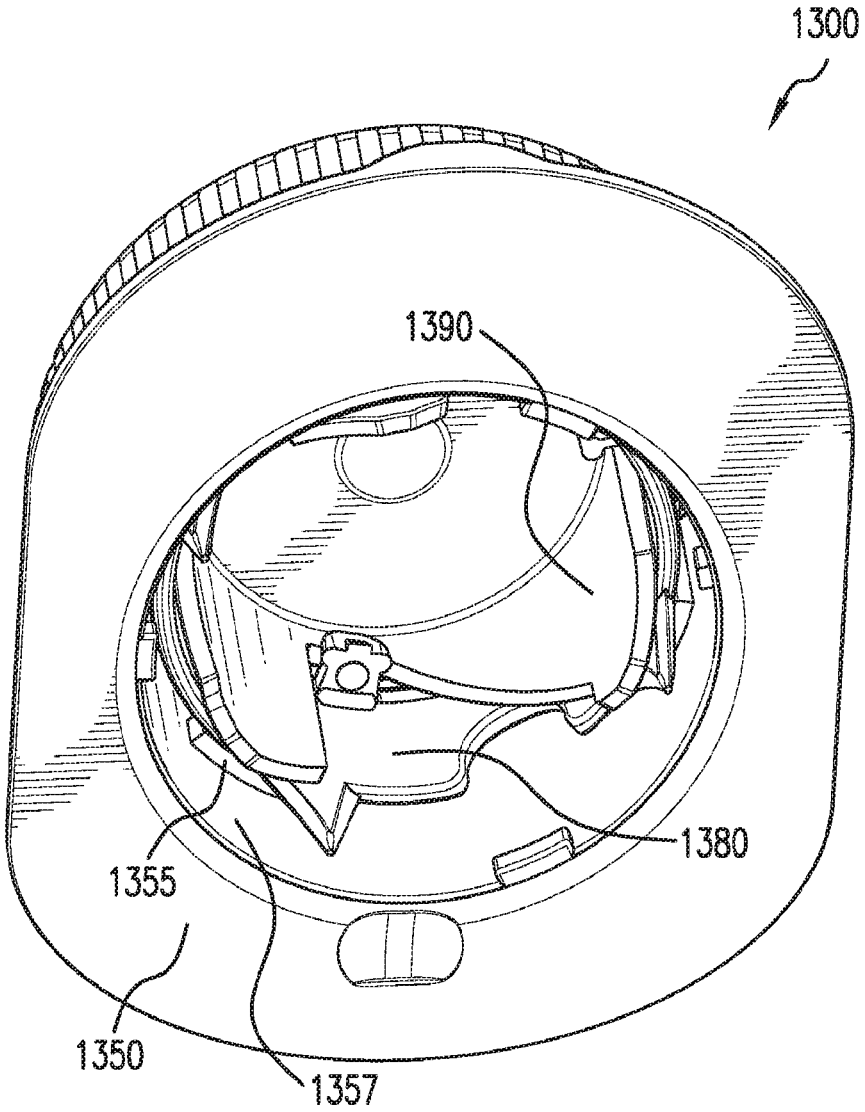
FIG. 14 is a bottom view of the tethered cap and spout combination of FIG. 13 in a closed position in accordance with certain implementations.

FIG. 14 is a bottom view of the tethered cap and spout combination of FIG. 13 in an open position in accordance with certain implementations. In addition to the elements shown in FIG. 13, and not repeated here for clarity, the tethered cap and spout combination 1300 further includes a puncturing mechanism 1380 which is engaged with protrusions 1355 on an internal wall 1357 of the spout 1350 and a camming mechanism 1390 disposed internally with respect to the base 1310 and the sidewall 1320.

Figure 15:
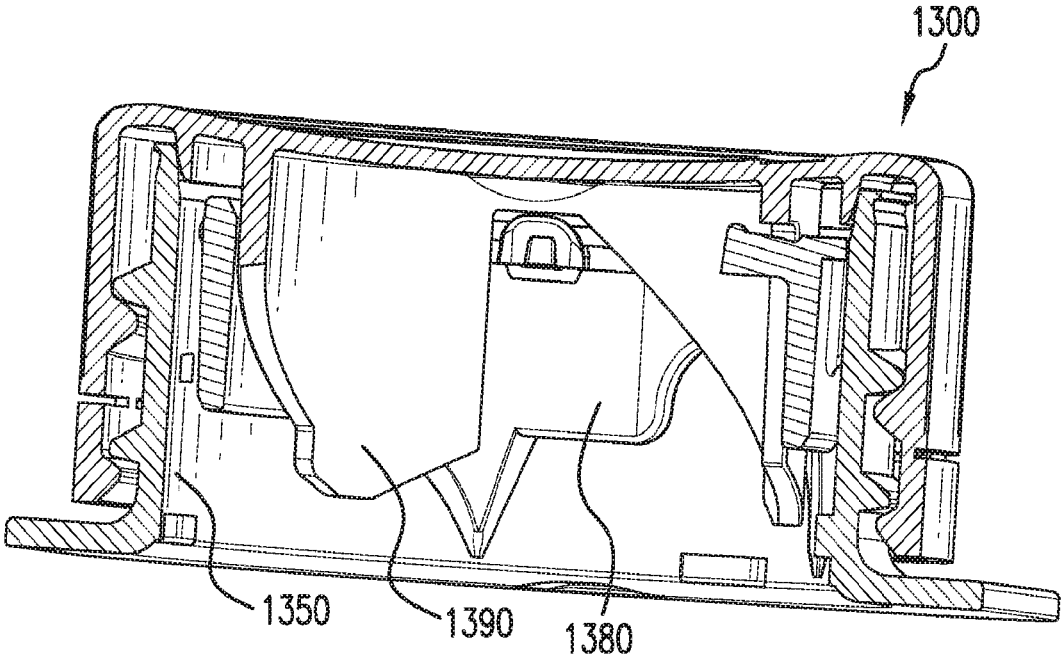
FIG. 15 is a cross-sectional view of the tethered cap and spout combination of FIG. 13 in a closed position in accordance with certain implementations.

FIG. 15 is a cross-sectional view of the tethered cap and spout combination of FIG. 13 in an open position in accordance with certain implementations and shows the elements described herein with respect to FIGS. 13-14.

Figure 16:
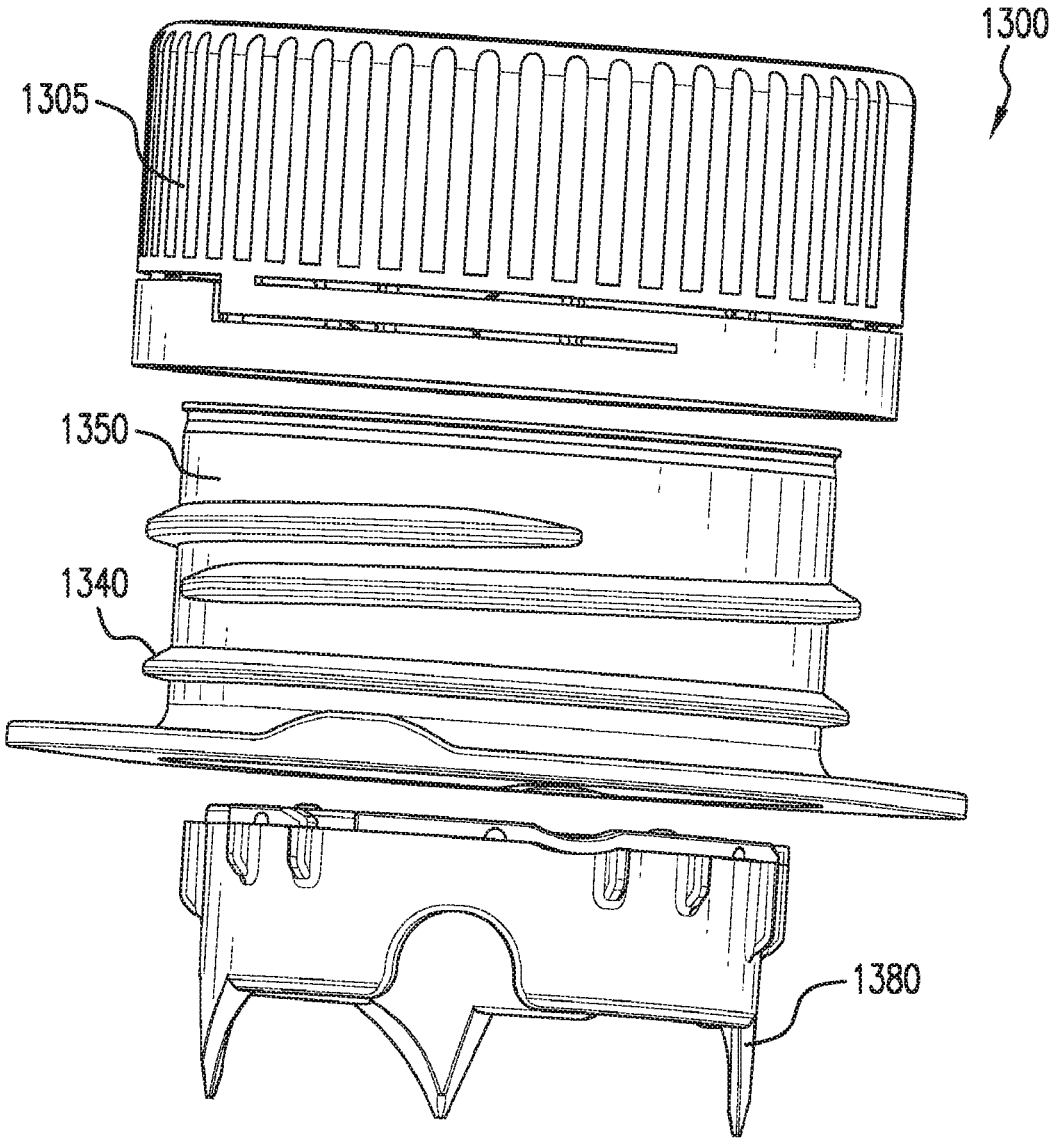
FIG. 16 is an exploded view of the tethered cap and spout combination of FIG. 13 in accordance with certain implementations.

FIG. 16 is an exploded view of the tethered cap and spout combination of FIG. 13 in an open position in accordance with certain implementations and shows the elements described herein with respect to FIGS. 13-15.

Figure 17:
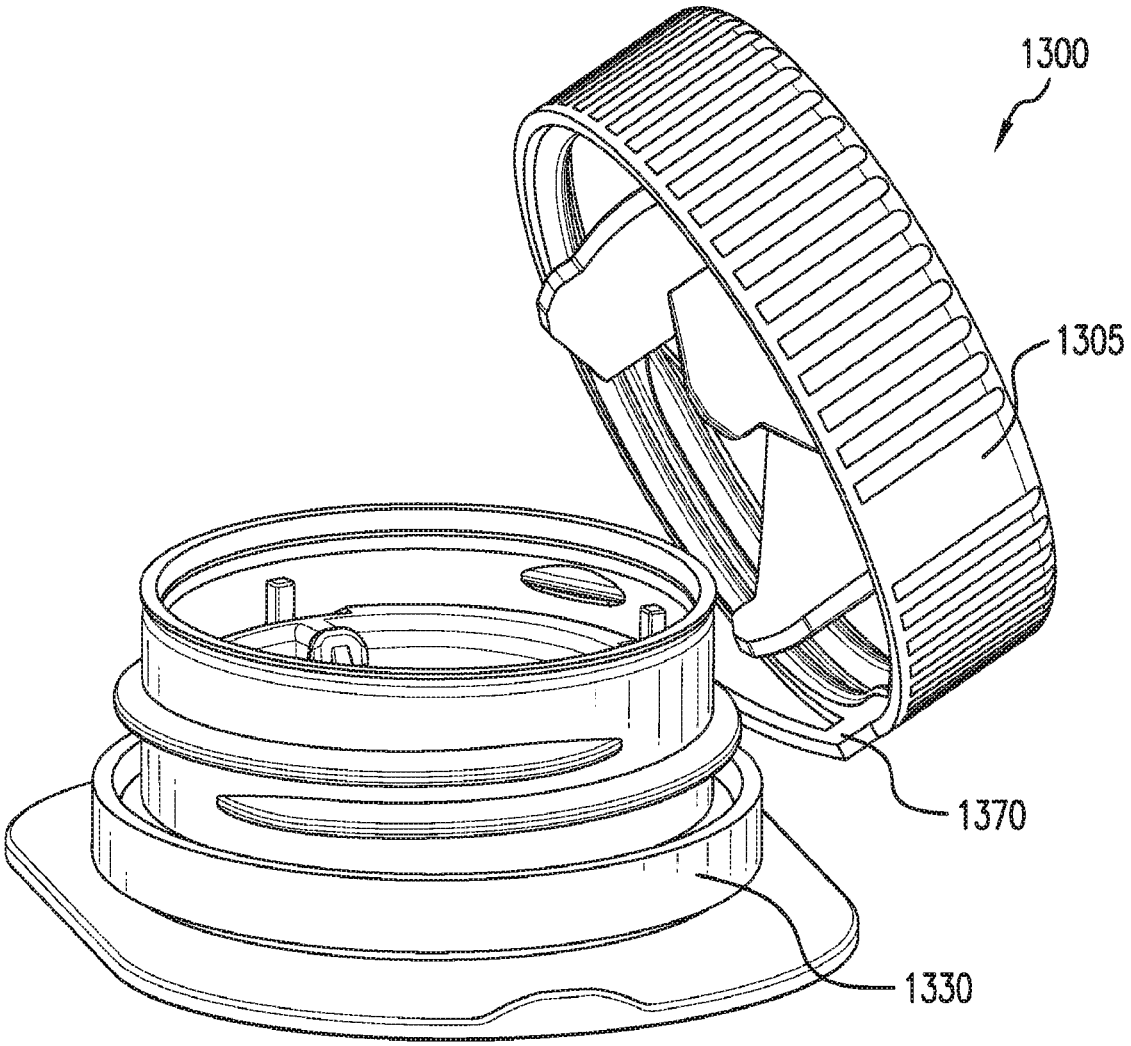
FIG. 17 is a view of the tethered cap and spout combination of FIG. 13 in an open position in accordance with certain implementations.

FIG. 17 is a view of the tethered cap and spout combination of FIG. 13 in an open position in accordance with certain implementations. In particular, the tether 1370 is tethering the cap 1305 to the retaining element 1330.

Figure 18:
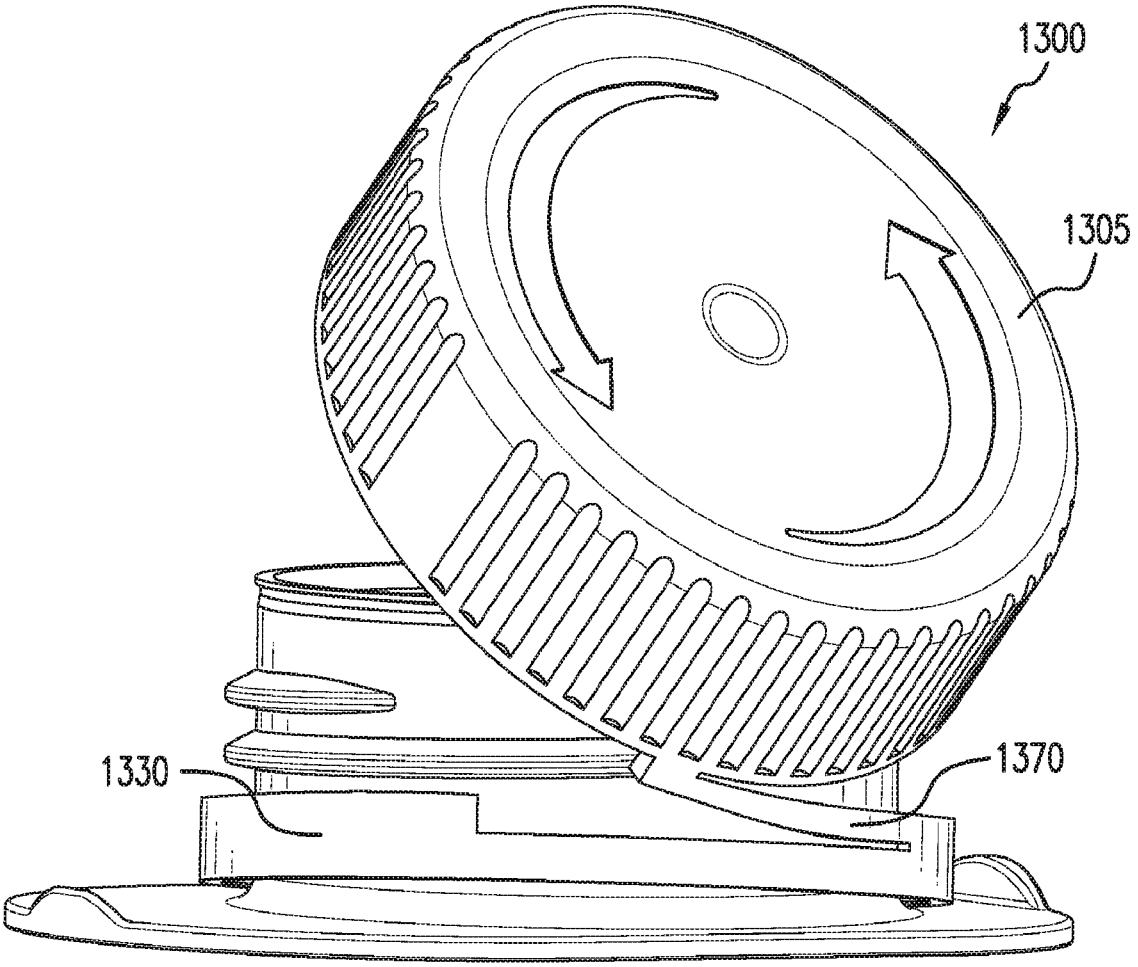
FIG. 18 is a view of the tethered cap and spout combination of FIG. 13 in an open position in accordance with certain implementations.

FIG. 18 is a view of the tethered cap and spout combination of FIG. 13 in an open position in accordance with certain implementations. In particular, the tether 1370 is tethering the cap 1305 to the retaining element 1330.

The tethered cap and spout combinations described herein may be manufactured using compression molding, injection molding and other like production processes. The tethered cap and spout may be made from polypropylene, high-density polyethylene, polyethylene terephthalate (PET) and the like.

Operationally, the cap 1305 is rotated (for example 360°). This ruptures the tether 1370 from the sidewall 1320 and the retaining element 1330. The camming mechanism 1390 engages the puncturing mechanism 1380, which may then puncture a seal on a container (where the tethered cap and spout combination 100 is implemented on the container). The cap 1305 is retained and kept away from an opening of the spout 1350 by the length of the tether 1370.

Figure 19A:
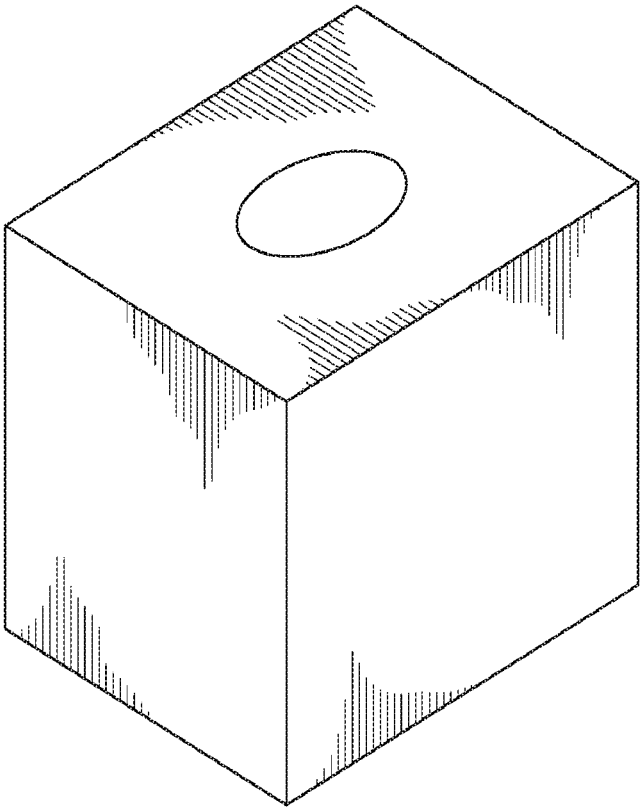
FIG. 19A is an example of a container.
Figure 19B:
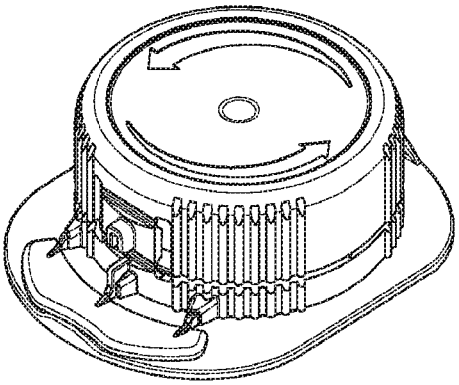
FIG. 19B is an example of a tethered cap and spout combination for use with the container of FIGS. 19A, and 19C is an example of a tethered cap and spout combination for use with the container of FIG. 19A in accordance with certain implementations.
Figure 19C:
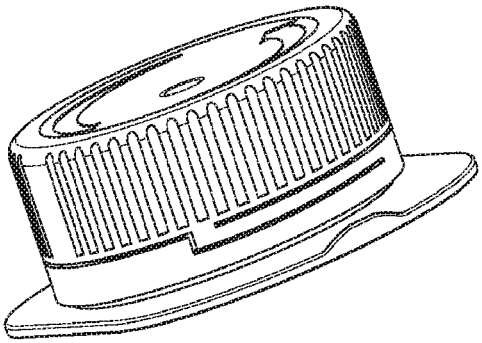

FIG. 19A is an example of a container 1900 including a seal 1910 which can be capped by a tethered cap and spout combination 1920 of FIG. 19B, a tethered cap and spout combination 1920 of FIG. 19C, or any of the tethered cap and spout combinations described herein with respect to FIGS. 1-18. The seal 1910 is punctured as described herein with respect to FIGS. 1-18.

In general, a tethered cap and spout combination includes a cap including a base, a sidewall and a camming mechanism on an internal side of the base and sidewall, a spout, a puncturing mechanism configured to be in engagement with at least the camming mechanism, a retaining element secured with respect to the spout, and a tether having a first end and a second end, the first end connected to the retaining element and the second end connected to the sidewall of the cap, where at least rotation of the cap engages the camming mechanism with the puncturing mechanism to push through a seal and engage the tether to hold the cap. In implementations, the at least rotation of the cap disengages the cap from the retaining element to engage the tether to hold the cap. In implementations, the tether further includes a first hinge at the first end of the tether and a second hinge at the second end of the tether. In implementations, the tether further comprising a slot and the retaining element further comprising a member, the slot configured to engage the member to retain the cap away from an opening. In implementations, further including a position retaining element tearably attached to the retaining element, the position retaining element configured to maintain the retaining element in a defined position prior to cap rupture. In implementations, the position retaining element includes a spout portion tearably connected to a retaining element portion. In implementations, further including a plurality of rupture elements connected to the sidewall of the cap and to the retaining element, the plurality of rupture elements configured to provide at least an anti-tampering mechanism to the tethered cap and spout combination. In implementations, further including a plurality of protrusions on an internal wall of the spout, the plurality of protrusions configured to engage the puncturing mechanism. In implementations, the spout further including a retaining element lock mechanism on an outer sidewall, the retaining element lock mechanism configured to engage the retaining element. In implementations, the tether further including a member including the first end and the second end, further including a first plurality of rupture elements connected to the member and the sidewall of the cap and a second plurality of rupture elements connected to the member and the retaining element. In implementations, further including a plurality of rupture elements connected to the sidewall of the cap and to the retaining element, the plurality of rupture elements, the first plurality of rupture elements, and the second plurality of rupture elements configured to provide at least an anti-tampering mechanism to the device. In implementations, further including a plurality of protrusions on an internal wall of the spout, the plurality of protrusions configured to engage the puncturing mechanism. In implementations, further including a retaining element lock mechanism on an outer sidewall, the retaining element lock mechanism configured to engage the retaining element.

In general, system including a container with seal and a tethered cap and spout combination secured to the container, the tethered cap and spout combination including a cap with a camming mechanism on an internal side of the cap, a spout, a puncturing mechanism configured to be in engagement with at least the camming mechanism and the spout, a retaining element secured with respect to the spout, and a tether connected to the retaining element and the cap, where at least rotation of the cap engages the camming mechanism with the puncturing mechanism to push through a seal and engage the tether to hold the cap. In implementations, the at least rotation of the cap disengages the cap from the retaining element to engage the tether to hold the cap. In implementations, the tether further including a first hinge at a first end of the tether, a second hinge at a second end of the tether, and a slot, and the retaining element further including a member, the slot configured to engage the member to retain the cap away from a punctured seal. In implementations, further including a position retaining element tearably attached to the retaining element, the position retaining element configured to maintain the retaining element in a defined position prior to cap rupture. In implementations, further including a plurality of rupture elements connected to the cap and to the retaining element, the plurality of rupture elements configured to provide at least an anti-tampering mechanism to the device. In implementations, the tether further comprising a member, the system further including a first plurality of rupture elements connected to the member and the cap and a second plurality of rupture elements connected to the member and the retaining element. In implementations, further including a plurality of rupture elements connected to the cap and to the retaining element, the plurality of rupture elements, the first plurality of rupture elements, and the second plurality of rupture elements configured to provide at least an anti-tampering mechanism to the device.

The construction and arrangement of the methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials and components, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A tethered cap and spout combination comprising:

a cap including a base, a sidewall, and a camming mechanism on an internal side of the base and the sidewall;

the spout;

a puncturing mechanism configured to engage the camming mechanism;

a retaining element attached to the spout and positioned above the spout and below the cap;

a tether having a first end connected to the retaining element and a second end connected to the sidewall of the cap, the tether comprising:

a first hinge at the first end of the tether;

a second hinge at the second end of the tether; and a retaining element lock mechanism positioned between the first hinge and the second hinge; and a rupture mechanism comprising:

a spout portion connected to an upper surface of the spout; and retaining element portions connected to an outer surface of the retaining element and tearably connected to the spout portion, wherein rotating the cap relative to the spout severs the tearable connection between the spout portion and the retaining element portions, wherein the retaining element portions and the spout portion are configured to cooperatively maintain a position of the retaining element and the cap relative to the spout prior to rotating the cap and severing the tearable connection, wherein rotating the cap relative to the spout engages the camming mechanism with the puncturing mechanism to push the puncturing mechanism through a seal, and wherein the retaining element lock mechanism is configured to lock with a cap member formed on one of the retaining element portions of the rupture mechanism to hold the cap away from the spout after disengaging the cap from the retaining element by flipping open the cap.

2. The tethered cap and spout combination of claim 1, wherein the sidewall of the cap is tearably connected to the retaining element via cap-retaining elements, and wherein flipping open the cap severs the cap-retaining elements to disengage the cap from the retaining element and to engage the tether to hold the cap.

3. The tethered cap and spout combination of claim 2, wherein the cap-retaining elements are rupture elements configured to provide at least an anti-tampering mechanism to the tethered cap and spout combination.

4. The tethered cap and spout combination of claim 3, further comprising:

a plurality of protrusions on an internal wall of the spout, the plurality of protrusions configured to engage the puncturing mechanism.

5. A system comprising:

a container; and a tethered cap and spout combination secured to the container, the tethered cap and spout combination comprising:

a cap including a base and a sidewall;

the spout;

a retaining element secured to the spout and including a plurality of retaining element portions;

a tether having a first end connected to the retaining element and a second end connected to the sidewall of the cap, the tether comprising:

a first hinge at the first end of the tether;

a second hinge at the second end of the tether; and a slot positioned between the first hinge and the second hinge;

a first plurality of rupture elements connecting the sidewall of the cap to the retaining element; and a second plurality of rupture elements connecting the plurality of retaining element portions of the retaining element to the spout, wherein rotating the cap severs the second plurality of rupture elements, wherein the second plurality of rupture elements are configured to cooperatively maintain a defined position of the retaining element prior to cap rupture, wherein rotating the cap engages the tether to hold the cap, and wherein the slot is configured to engage a cap member formed on one of the retaining element portions of the plurality of retaining element portions to hold the cap away from an opening of the spout.

6. The system of claim 5, wherein flipping open the cap severs the first plurality of rupture elements to disengage the cap from the retaining element and to engage the tether to hold the cap.

7. The system of claim 5, wherein the first plurality of rupture elements and the second plurality of rupture elements are configured to provide at least an anti-tampering mechanism to the system.

8. The system of claim 7, wherein the tether further comprises a member;

the first plurality of rupture elements are connected to the member of the tether and the cap; and the second plurality of rupture elements are connected to the member of the tether and the retaining element.

9. The tethered cap and spout combination of claim 1, wherein the retaining element lock mechanism is a slot, and wherein the slot is configured to receive the cap member.

10. The tethered cap and spout combination of claim 1, wherein the cap is rotated at least 180 degrees relative to the spout to push the puncturing mechanism through the seal.

11. The system of claim 5, wherein the slot is configured to receive the cap member to lock the tether with the retaining element.

12. The system of claim 5, wherein:

the container includes a seal positioned adjacent to the opening of the spout, the cap further includes a camming mechanism on an internal side of the base and the sidewall, the tethered cap and spout combination further comprises a puncturing mechanism configured to engage the camming mechanism and the spout, and rotating the cap causes the camming mechanism to engage the puncturing mechanism to push the puncturing mechanism through the seal of the container.

13. The system of claim 12, wherein the spout includes a plurality of protrusions on an internal wall of the spout, and wherein the plurality of protrusions is configured to engage the puncturing mechanism.

14. The system of claim 12, wherein the cap is rotated at least 180 degrees to push the puncturing mechanism through the seal of the container.

* * * * *